United States Patent [19]

Washington

[11] 4,002,229

[45] Jan. 11, 1977

[54] TRASH CHUTE LOCKING SYSTEM

[76] Inventor: Norris J. Washington, 5419 16th Ave., Terrace 2, Hyattsville, Md. 20782

[22] Filed: May 19, 1975

[21] Appl. No.: 578,857

[52] U.S. Cl. ..... 193/34; 141/98; 169/61; 250/574

[51] Int. Cl.[2] ..... E04F 17/10

[58] Field of Search ..... 169/61; 250/574, 577, 250/522; 193/33, 34; 302/27; 141/98; 239/195; 100/99

[56] References Cited

UNITED STATES PATENTS

| | | | |
|---|---|---|---|
| 3,171,447 | 3/1965 | Fowler et al. | 141/95 |
| 3,524,707 | 8/1970 | Hansen et al. | 250/574 |
| 3,690,560 | 9/1972 | Boyd | 239/195 |
| 3,695,172 | 10/1972 | Cleary et al. | 100/99 |

FOREIGN PATENTS OR APPLICATIONS

| | | | |
|---|---|---|---|
| 34,822 | 12/1964 | Germany | 250/577 |

*Primary Examiner*—Houston S. Bell, Jr.
*Attorney, Agent, or Firm*—Beveridge, DeGrandi, Kline & Lunsford

[57] ABSTRACT

A system for locking the doors of a trash chute located within a multi-story structure. A beam of radiant energy extends the length of the chute to a receiver, and upon interruption of the beam by blockage of the chute, the receiver transmits a signal to a detector which in turn energizes locking means to lock all entries to the trash chute until the blockage has been removed. Fire-sensing means and a source of water to flood the chute are also utilized should the blockage catch fire before being removed.

9 Claims, 4 Drawing Figures

TRASH CHUTE LOCKING SYSTEM

BACKGROUND OF THE INVENTION

This invention relates to trash chutes, and more particularly to a system for preventing entry into the trash chute when a blockage occurs therewithin, and for extinguishing fires in the chute.

Most modern multi-storied structures, both apartment dwellings or office buildings, are provided with a trash chute extending the entire height of the building in order to enable the occupants of the building to deposit trash conveniently at each floor, rather than having to carry the trash to a common receptacle normally located in the basement of the building. The normal trash chute comprises a shaft extending the height of the building with entrance openings therein at each floor of the structure for deposit of trash within the trash chute. Each opening is provided with a door which can be opened when the occupant desires to deposit trash in the trash chute.

Prior developments in this field have dealt with situations where the trash receptacle located at the base of the trash chute has become overfilled with matter deposited therein. For example, U.S. Pat. No. 3,171,447 disclosed an apparatus for locking the entry door to a trash chute when the receiving bin is filled to capacity.

Often, however, a trash chute can become blocked, either when oversized objects are inserted into the chute, or when several objects falling within the chute entangle before falling the entire length of the chute, causing additional trash later dumped within the chute to collect on top of the blockage, seriously increasing the possibility of fire or other damage to the building.

The present invention seeks to prevent additional trash from being deposited within the trash chute when a blockage occurs. Radiant energy from a suitable source is directed the length of the trash chute, and is received by a receiver means located within the chute. If a blockage occurs in the chute, the radiant energy beam is blocked. Immediately, or after a short time delay provided by a standard time delay means, the receiver transmits signals to a detector which in turn locks each entry into the trash chute via a suitable locking mechanism. If the blockage is temporary or is later removed, the beam emanating from the radiant energy source is restored to the receiver, and the trash chute doors are subsequently unlocked. However, if the blockage continues, the trash chute doors remain locked until the blockage has been removed from the trash chute.

To detect and extinguish any fire which may occur in a blockage, heat sensors are located near each entrance. Detection of a fire by a heat sensor causes flooding of the chute.

Various specific details of the invention will become more apparent in the following detailed description of a preferred embodiment of the invention taken in conjunction with the drawing.

DETAILED DESCRIPTION OF A PREFERRED EMBODIMENT OF THE INVENTION

Figure 1:
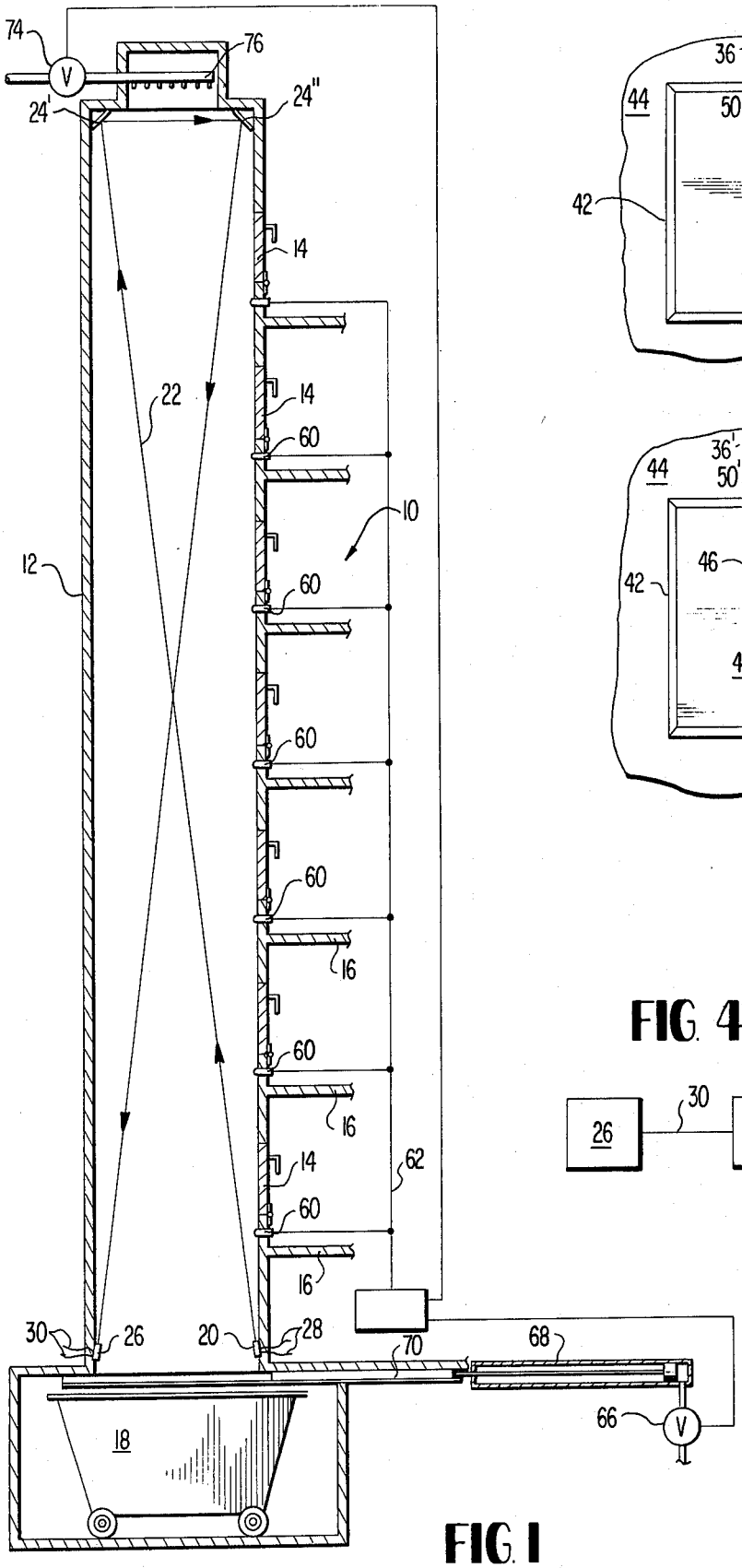
FIG. 1 is a side elevational view of a trash chute located within a building employing the locking system of the present invention.

Referring to FIG. 1, the normal trash chute 10 consists of an elongated shaft 12 and multiple entrances 14 located at each story 16 of the building in which the trash chute is located. A hopper 18 is located at the base of the shaft 12 to receive all the trash which has been deposited through entrances 14.

To prevent additional matter from being deposited in shaft 12 should an obstruction occur, I provide a radiant energy source 20, such as a light source, which directs a beam 22 the length of shaft 12, beam 22 being reflected by mirrors 24' and 24'' to a receiver means 26, such as a photoelectric cell, located at the bottom of the shaft. Radiant energy source 20 is energized by a suitable source of electrical current through wires 28, while receiver means 26 can transmit electrical signals through wire 30.

Figure 4:
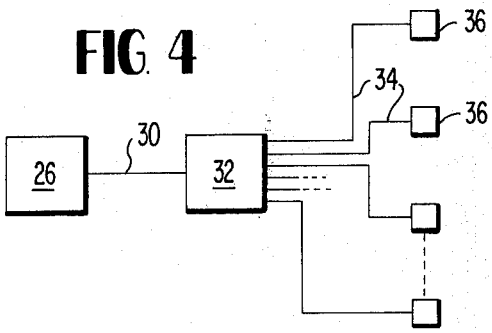
FIG. 4 is a diagrammatic representation of the locking system of the present invention.

Should beam 22 be broken by falling material within shaft 12, or by a blockage therewithin, receiver 26 no longer receives the beam 22. Thereupon, receiver 26 transmits signals to detector 32 through wires 30 (FIG. 4) indicating that an interruption of the beam 22 has occurred. Immediately, or after a short time delay, detector 32 transmits signals through wire 34 to actuate a locking mechanism 36 located in each of the entrances 14. The detector 32 may also actuate alarm means to indicate a blockage in the trash chute. An audible alarm may be located in the maintenance room, office or resident manager's apartment so that maintenance personnel will be informed of the blockage. A flashing light or other visible alarm may be positioned adjacent each of the chute entrances 14 to inform occupants of the malfunction of the trash chute system.

Figure 2:
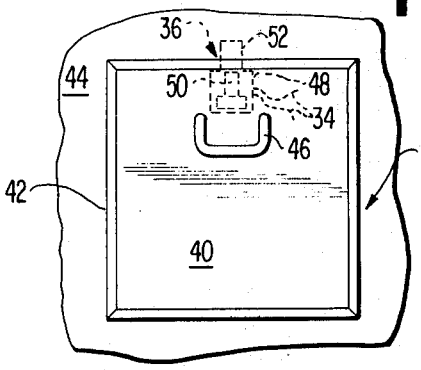
FIG. 2 is a sectional view of one of the several entry doors employing a particular locking mechanism.

As shown in greater detail in FIG. 2, entrance 14 comprises a hinged door 40 within frame 42 in the wall 44 of the building in which trash chute 10 is located. The door 40 is provided with a handle 46. The locking mechanism is located at a suitable position within door 40 and frame 42, and comprises a solenoid 48 or the like with an armature and bolt 50. The bolt is normally spring biased in an unlocked position within door 40. If solenoid 48 energized through wires 34 by signals from detector 32, bolt 50 is thrust into a locking position within a suitable aperture 52 located within frame 42, thereby preventing the opening of door 40 until solenoid 48 has been deenergized.

Figure 3:
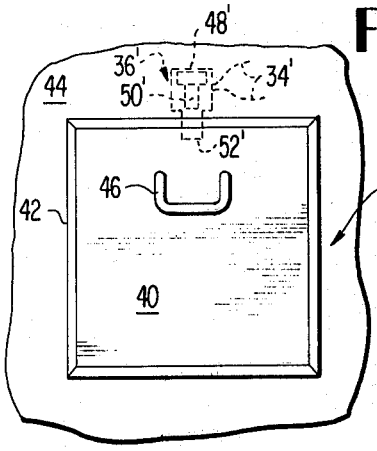
FIG. 3 is a sectional view of an alternative for the locking mechanism of FIG. 2.

FIG. 3 shows an alternative to the locking mechanism of FIG. 2 wherein a locking mechanism 36' is located within building 44 instead of within door 40. Upon receipt of signals from detector 32 on line 34', solenoid 48' is energized, forcing bolt 50' to seat in a locking position in the aperture 52' located within door 40. Opening of door 40 is thereby precluded until solenoid 48' has been deenergized.

After the obstruction has been cleared, beam 22 is restored within chute 10. Indication of restoration is transmitted by receiver means 26 to detector 32 which in turn deenergizes solenoids 48 or 48' immediately or after a predetermined time delay period.

To detect any fire which may occur in a blockage in the trash chute 10, a fire sensor 60 is situated near each entrance 14. The fire sensors 60 are of conventional construction and may operate on ionization, smokedetection or temperature-sensing principles. If a fire is detected by one of sensors 60, it will generate an electrical signal indicative of the fire detection. The electrical signal passes along wire 62 to open valve 66 which immediately causes hydraulic means 68 to close door 70 across the bottom of shaft 12. The electrical signal also passes along wire 62, acting through conventional circuitry (now shown), to actuate a valve 74 to cause water to flow through nozzle 76 and flood the shaft 12.

It will be apparent that the invention provides a simple, yet effective means for extinguishing fires and for preventing trash from being deposited within a trash chute when a blockage occurs in the chute. It is also apparent that various modifications can be made to the invention without departing from the true spirit thereof. For example, the light source may be located at one end of the trash chute, with the receiver being located at the other end in place of the mirrors described in the present preferred embodiment. Furthermore, the light source and photoelectric cell of FIG. 1 may be located at the top of the trash chute, with the mirrors being located at the bottom thereof, although the above-described configuration is preferred to provide two portions of the same light beam in different positions within the same chute. Therefore, the present invention is not limited to the typical embodiments disclosed, but encompasses many other structures within the spirit of the following claims:

I claim:

1. A trash chute system for preventing trash from being deposited in a trash chute which has a blockage in a multi-story structure including:

a trash chute having multiple entrances, beam-emitting means for transmitting a beam longitudinally of said chute past a plurality of said entrances, receiver means positioned in the path of said beam to receive said beam, means connected to the receiver means for generating a malfunction signal when the beam is interrupted between the entrances and between the beam-emitting means and the receiver means, and access-preventing means at each trash chute entrance operable in response to said malfunction signal to prevent entry to said chute and to prevent trash from being deposited when there is a blockage in the trash chute.

2. Apparatus of claim 1 wherein said beam-emitting means and said receiver means are located at the same end of said chute, and reflector means located at the other end of said chute for directing said beam from said beam-emitting means to said receiver means.

3. Apparatus of claim 2 including plural reflector means.

4. Apparatus of claim 1 wherein said access-preventing means includes a normally closed door in each said entrance, and locking means for locking said door in its closed position upon receipt of said malfunction signal.

5. Apparatus of claim 1 wherein said beam emitting means transmits a beam of radiant energy.

6. Apparatus of claim 5 wherein said radiant energy is light, and said receiver means is a light-sensitive photocell.

7. Apparatus of claim 5 wherein said access-preventing means includes a normally closed door in each said entrance and locking means for locking said door in its closed position upon receipt of said malfunction signal.

8. Apparatus of claim 1 including fire-sensing means located within the chute to detect combustion in said trash chute and generate a fire-indication signal.

9. Apparatus of claim 8 including means to close the lower end of said trash chute and means to flood said trash chute with water in response to the fire-indication signal.

* * * * *